US006550224B2

(12) United States Patent
Kleinschmidt

(10) Patent No.: US 6,550,224 B2
(45) Date of Patent: Apr. 22, 2003

(54) METHOD FOR PRODUCING STAND-UP BLISTER PACKAGES, AND APPARATUS FOR EXECUTING THE METHOD

(75) Inventor: Ekkehard Kleinschmidt, Heilbronn-Frankenbach (DE)

(73) Assignee: Adolf Illig Maschinenbau GmbH & Co., Heilbronn (DE)

( * ) Notice: Subject to any disclaimer, the term of this patent is extended or adjusted under 35 U.S.C. 154(b) by 0 days.

(21) Appl. No.: 09/933,350

(22) Filed: Jul. 12, 2001

(65) Prior Publication Data

US 2002/0059783 A1 May 23, 2002

(30) Foreign Application Priority Data

Jul. 12, 2000 (DE) ..... 100 33 796

(51) Int. Cl.[7] ..... B65B 47/00

(52) U.S. Cl. ..... 53/453; 53/282; 53/329.4; 53/561; 53/478

(58) Field of Search ..... 53/561, 559, 282, 53/329.2, 329.4, 329.3, 453, 467, 478, 477

(56) References Cited

U.S. PATENT DOCUMENTS

| | | | | |
|---|---|---|---|---|
| 3,093,244 A | | 6/1963 | Middleton, Jr. et al. | |
| 4,784,268 A | | 11/1988 | Perchak | |
| 4,901,858 A | | 2/1990 | Anderson | |
| 5,054,271 A | * | 10/1991 | DeWoskin | 53/329 |
| 5,379,572 A | * | 1/1995 | Giovannone | 53/329.3 |
| 5,600,939 A | * | 2/1997 | Giovannone | 53/374.5 |
| 5,603,203 A | * | 2/1997 | Robache | 53/257 |
| 6,282,870 B1 | * | 9/2001 | Robache | 53/377.6 |

FOREIGN PATENT DOCUMENTS

| | | | |
|---|---|---|---|
| DE | 37 22 214 | | 1/1989 |
| DE | 41 25 335 | | 2/1993 |
| GB | 2258207 A | * | 2/1993 |

* cited by examiner

*Primary Examiner*—Ted Kavanaugh
(74) *Attorney, Agent, or Firm*—Venable; Norman N. Kunitz

(57) ABSTRACT

A method for producing stand-up blister packages, and in particular a stable, easy-to-fill stand-up blister package that has no undercut of the blister dome, and can be produced with a high cycle number, without malfunctions and with a good, reproducible quality, in hot-seal machines. For this purpose, a fold line is produced through the heating of a linear region, independently of the heating during the process of sealing the blister edges with the carrier part. The apparatus has a corresponding heating station for heating and creating a fold line in the blister dome.

18 Claims, 5 Drawing Sheets

METHOD FOR PRODUCING STAND-UP BLISTER PACKAGES, AND APPARATUS FOR EXECUTING THE METHOD

CROSS REFERENCE TO RELATED APPLICATION

This application claims the priority of German Patent Application No. 100 33 796.1 filed Jul. 12, 2000, which is incorporated herein by reference.

BACKGROUND OF THE INVENTION

The invention relates to a method for producing stand-up blister packages, in which method blister domes are shaped from a film sheet of thermoplastic plastic, separated from the film sheet, transferred into circulating, cyclically-moved sealing pallets, and filled and sealed with a carrier part through large-surface heating of the blister edges. The invention additionally relates to an apparatus for executing the method. The stand-up blister packages produced with the method have a high market appeal, because the consumer can easily read and identify the imprint on the carrier part when the. stand-up blister packages are arranged appropriately in store shelves.

A method of the above described type and an apparatus for generally carrying out that method are described in German laid open application DE 37 22 214 A 1. The blister packages produced with the method and apparatus have a blister edge that extends around the entire perimeter and protrudes over the entire contour of the blister dome, and prevents the packages from being displayed in an eye-catching, compact manner, namely, being stood up on a side wall of the blister dome.

U.S. Pat. No. 4,901,858 discloses a stand-up blister package in which the four blister edges are sealed with a carrier part. The provision of an undercut on one side of the blister dome, the undercut being approximately as wide as the blister edge, lends the package the stability required for standing. This undercut hinders the shaping of the blister dome, because it necessitates horizontal movements of the tool parts. Sealing the blister edge in the region of the undercut in the sealing station of an automatic blister-package machine also requires complicated tools with horizontally-moving parts, because the heated sealing electrode requires a countersurface for sealing. This countersurface must, however, be moved away laterally before it is moved downward. Because the blister dome must often be adapted precisely to the item to be packaged, a deviation in forming the undercut is unacceptable as a rule. The item would be too loosely packaged.

U.S. Pat. No. 3,093,244 proposes sealing all four blister edges of the blister dome with the carrier part and folding one of the sealed edges by about 90°. These stand-up blister packages lack stability, because the folded sealed edge is not secured. The edge therefore bends back to varying degrees, so the stand-up blister packages appear crooked, which has a negative visual effect. If the folded sealed edge were to be secured with suitable measures, the stand-up blister packages would be very bulky and difficult to stack, and would require considerable space for shipping from the packaging site to the retailer.

It is the object of the invention to execute the method to produce blister packages in which a blister edge only protrudes on three sides of the blister dome. On the fourth side, the blister edge is intended to be brought into a fixed position, so the blister package can stand directly on the side wall of the blister dome on this side. It should not be necessary to create an undercut in the blister dome. The blister packages are supposed to be packed compactly.

SUMMARY OF THE INVENTION

The above object generally is achieved according to a first aspect of the invention by a method for producing stand-up blister packages, in which blister domes with blister edges are shaped from a film sheet of thermoplastic plastic, separated from the film sheet, transferred into circulating, cyclically-moved sealing pallets, filled with an item and sealed with a carrier part through the large-surface heating of the blister edges, with the method including the following method steps:

- sealing one of the blister edges with the carrier part in a transverse-sealing station;
- cooling the one blister edge and the carrier part to form a stand-up blister package pre-form;
- linearly heating the transition region of the one blister edge between the blister dome and the carrier part in a heating station to form a narrow, heated fold line;
- folding the carrier part and the one blister edge connected thereto by 180° along the heated fold line; and,
- sealing the remaining blister edges with the carrier part to form the sealed stand-up blister package.

The above object generally is achieved according to a second aspect of the invention by an apparatus for producing stand-up blister packages according to the method of the invention including a shaping portion or section for providing shaped blister domes having blister edges; and a sealing portion or section with at least one circulating pallet belt having pallets with openings for receiving the blister domes and carrier portions on a surface of the pallets such that one blister edge overlaps a portion of a respective associated carrier, in the region of the at least one circulating pallet belt, a filling station, a transverse-sealing station for sealing the one blister edge with the carrier part, a folding station for folding the carrier part by 180°, a sealing station for sealing the other blister edges with the carrier part, and a heating station that is disposed between the transverse-sealing station and the folding station, with the heating station having a heated heating strip for warming a linear region of the blister dome in order to create a heated fold line. Advantageous modifications of the invention are disclosed and described.

The method is described in detail by use of schematic drawings of the apparatus for executing the method.

DETAILED DESCRIPTION OF THE PREFERRED EMBODIMENTS

Figure 1:
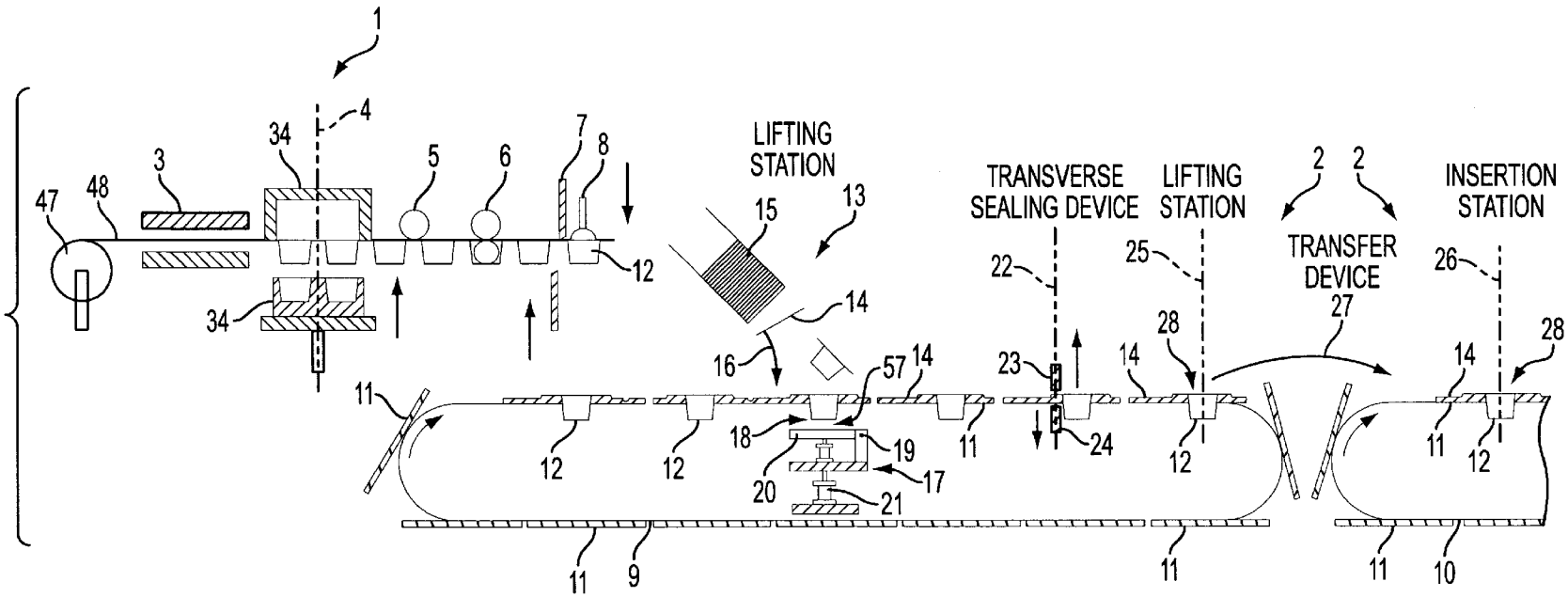
FIG. 1 is a side view of a portion of the apparatus for executing the method.
Figure 2:
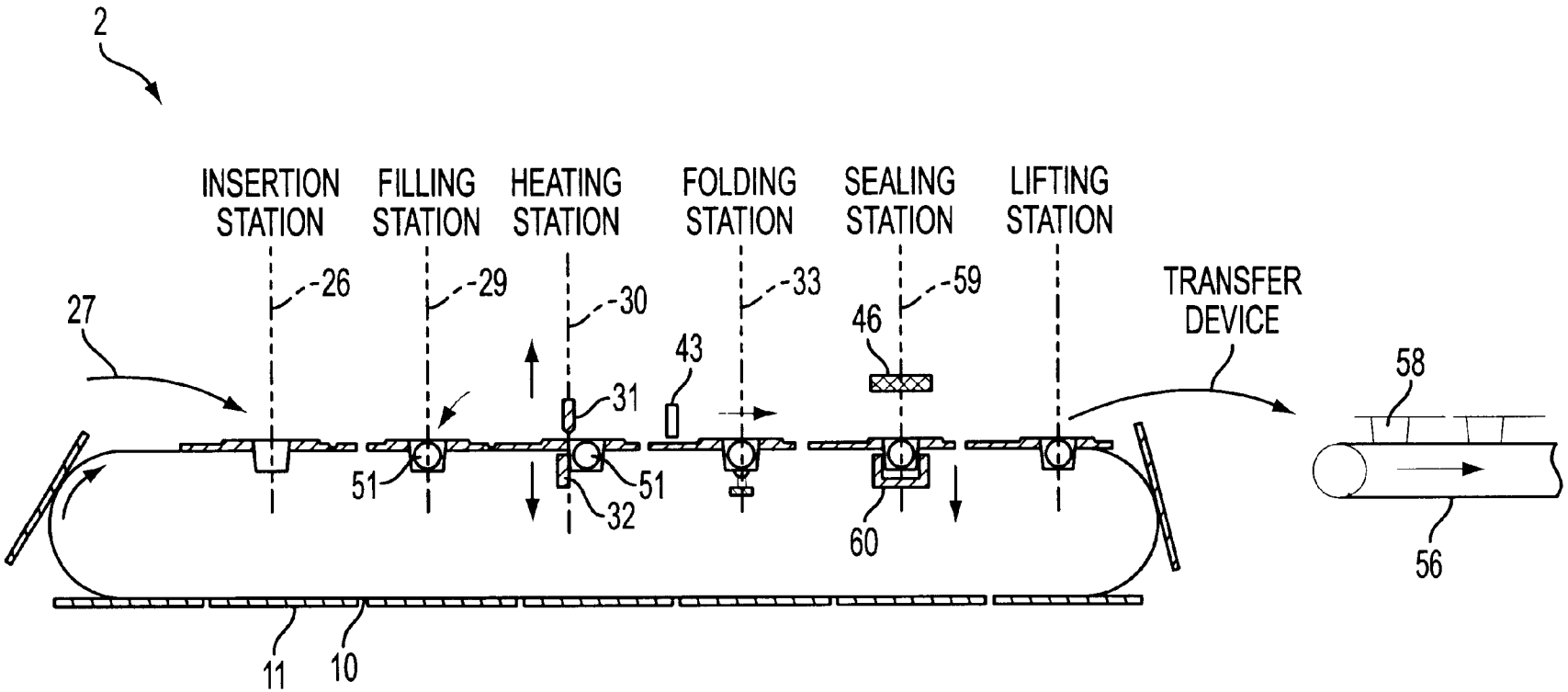
FIG. 2 is a side view of the remainder of the apparatus of FIG. 1.

Referring now to FIG. 1, there is shown an apparatus for executing the method which generally comprises the shaping section 1 and the sealing section 2. Disposed in the shaping section 1, in sequence, are a heating device 3, a shaping device 4, a longitudinal-cutting device 5, a transport device 6, a transverse-cutting device 7 and a transfer device 8. The sealing section 2 comprises two cyclically-moving pallet belts 9, 10 having circulating pallets 11 mounted thereon. These pallets 11 have a row of holes or openings, corresponding to the shape of the blister domes 12 inserted into them by the transfer device 8. In the region of the first pallet belt 9, following the insertion in the feed direction, is a positioning station 13 for the carrier parts of carrier 14, preferably comprising cardboard, which are kept stacked in a magazine 15, and removed individually by a transfer device 16 and placed onto the pallets 11, one for each blister dome 12.

Figure 6:
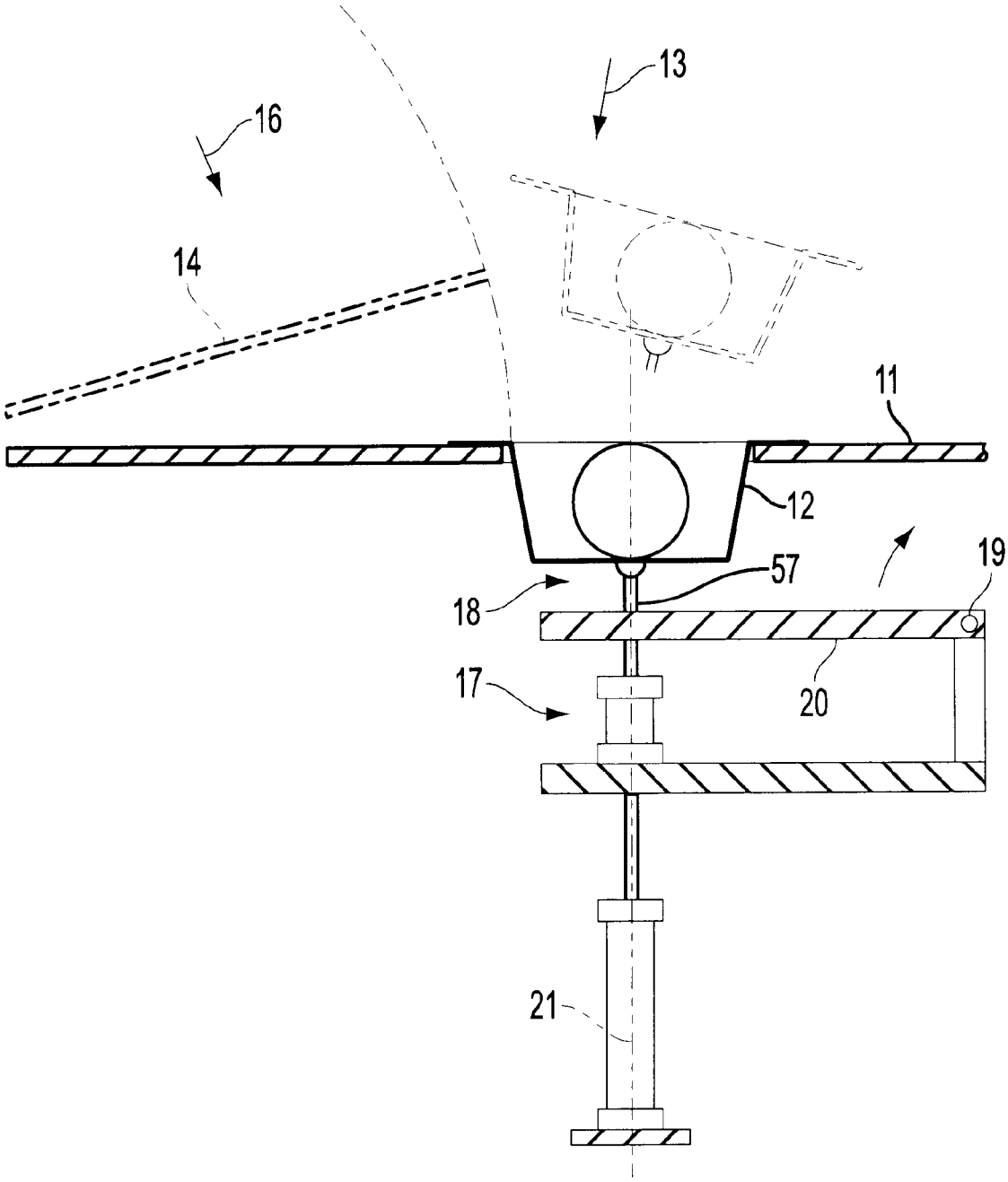
FIG. 6 is an enlarged representation of the positioning station.

Disposed beneath the plane of the pallets 11 on the upper reach of the belt 9 in the region of the positioning station 13 is a lifting device 17 (FIG. 6) comprising a holding device 18 with suction elements 57 for securely holding each blister dome 12 of a row seated on a holding strip 20 that can pivot about a point of rotation 19. The point of rotation 19, and thus the holding strip 20, are additionally embodied to be vertically displaced by a drive 21.

Figure 3:
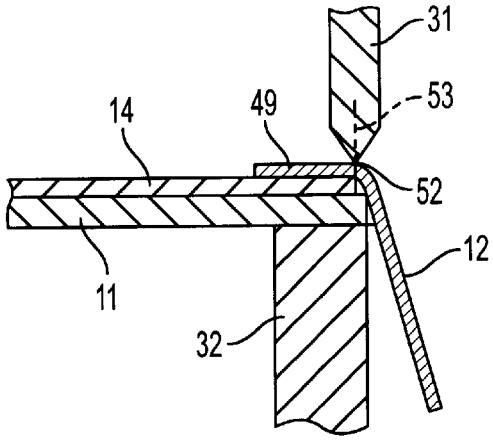
FIG. 3 is an enlarged representation of a portion of the transverse-sealing device.

Following in the direction of passage is a transverse-sealing device 22 having a sealing electrode 23, which can be adjusted in height, and—if necessary—a counter-strip 24, which also can be adjusted in height for sealing one edge of a blister dome 12 to its associated carrier 14. The first pallet belt 9 ends with a lifting station 25, while the second pallet belt 10 begins with an insertion station 26. A transfer device 27, represented by an arrow, serves to remove the pre-formed stand-up blister packages 28, each comprising a blister dome 12 and attached carrier 14, from the pallet belt 9 and inserting them into the pallet openings of the pallet belt 10. Following the insertion station 26 is a filling station 29, in which the item 51 to be packaged is inserted into the blister domes 12. Adjoining this station is a heating station 30 with a heated heating strip 31 that can be adjusted in height, and—if necessary—an oppositely-located counter-strip 32, which can likewise be adjusted in height. FIG. 3 is an enlarged representation of the heating station 30.

Figure 4:
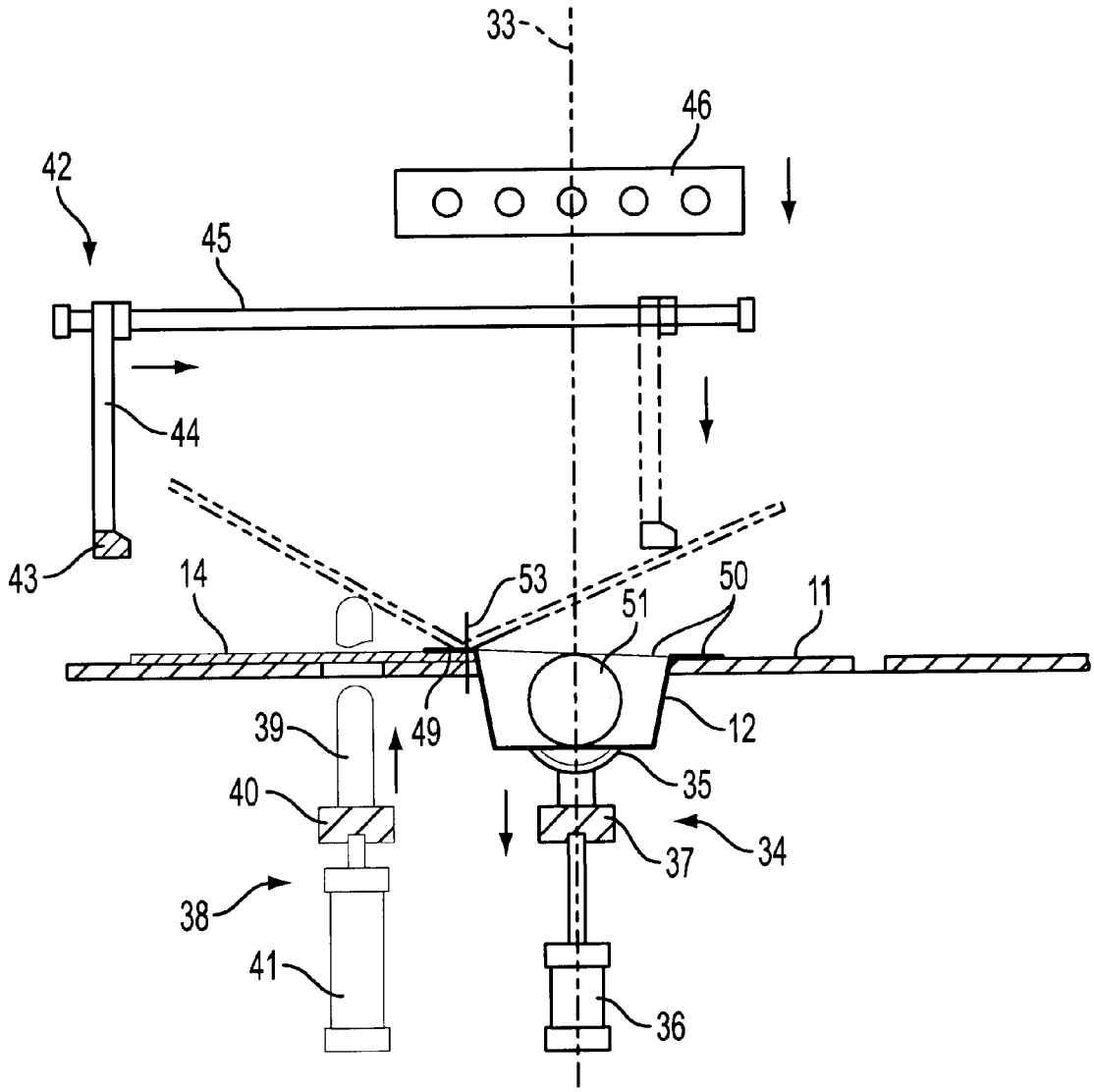
FIG. 4 is an enlarged representation of the folding device.

The folding station 33, shown on an enlarged scale in FIG. 4, follows the heating station 30. Disposed beneath the blister domes 12 in the folding station 33 is a holding device 34 comprising suction elements 35, which are seated on a transverse strip 37 that can be adjusted in height by the drive 36. The suction elements 35 can be connected intermittently to a vacuum source (not shown). A tilting device 38 comprising pins 39, a strip 40 that supports 39 the pins and a drive 41 for vertically displacing the strip 40 is seated beneath the sealed-on carrier part 14. Above the transport plane of the pallets 11 is a bending device 42, which comprises a bending strip 43 that is seated on carriers 44 that are guided on guides 45 and can be displaced horizontally by a drive, not shown, and vertically lowered by a second drive.

A sealing station 59 having a sealing electrode 46 adjoins the folding station 33. The electrode can be heated, and adjusted in height by a drive, not shown, to come into contact with the pallets 11. If needed, a countersurface 60 is provided.

The method is executed as follows:

In the shaping section 1, blister domes 12 are shaped in the mold 34 from the heated sheet 48 drawn from a roll 47, and severed from the sheet in cutting stations 5 and 7. The transfer device 8 grasps the severed blister domes 12 and spreads them in the transverse direction while transferring them into the openings of pallets 11 of the pallet belt 9. The blister domes 12 are thus spaced from one another in the transverse direction. After the pallets 11 have been transported into the positioning station 13, the blister domes 12 located in the pallets 11 are raised by the lifting device 17 such that the associated carrier parts 14 can be positioned on the pallets 11 (indicated by a dot-dash line), and when the blister domes 12 are re-lowered, one blister edge 49 rests on the associated carrier part 14, overlapping it. After a further transport step, the two parts come to a stop in the transverse-sealing device 22, and a large-surface seal is effected between the sealing edge 49 and the carrier part 14. The transfer device 27 subsequently transfers the two sealed parts, as a so-called stand-up blister package preform 28, into the second pallet belt 10. The pallet belt 10 guides the pallets 11 to the filling station 29, in which the item 51 is manually or automatically placed into the blister dome 12 of the package.

In the heating station 30, (See FIG. 3) the heating strip 31 heats a linear region of the blister edge 49 in the region that is not sealed with the carrier part 14 in order to form a fold line 53. The heating strip 31 preferably tapers to a slightly-rounded point, and is pressed against the blister edge 49 with an adjustable force, e.g., by a pneumatic cylinder with an adjustable pressure, so that a small groove 52 is formed as a fold line 53 during the heating process to permit the blister edge 49 to be folded back slightly).

In the next station, the folding station 33, the blister domes 12 are first held securely by the holding device 34 (position shown in FIG. 4) so that, when the pins 39 are raised, the carrier part 14 and the blister edge 49 buckle in the region of the fold line 53 (shown as a dot-dash line). The horizontal displacement of the bending strip 43 effects a further bending at the fold line 53. This position is also shown as a dot-dash line. The bending strip 43 is lowered (indicated by an arrow), and the bending continues to 180°.

In the downstream sealing station 59, the sealing electrode 46 is used to seal the three remaining blister edges 50 with the carrier part 14. A transfer device 61 (represented by an arrow) grasps the stand-up blister packages 5B in the adjoining lifting station 55, and places them onto a transport belt 56 or into cartons.

Figure 5:
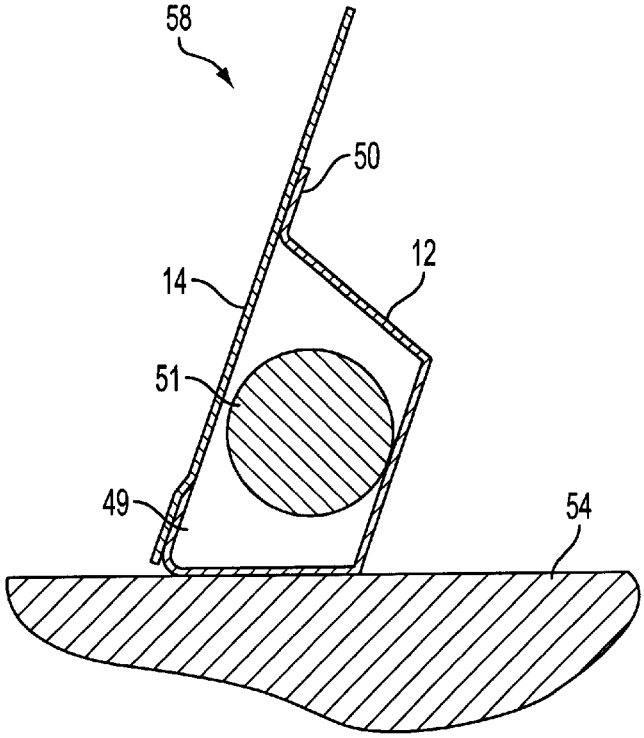
FIG. 5 is a section through a stand-up blister package.

Thus, a stand-up blister package 58 is formed, which offers an appealing appearance when placed on a surface 54, as shown in FIG. 5.

During the transport of the blister domes 12 from the transverse-sealing station 22 to the heating station 30, the sealed blister edge 49 and the adjoining region of the blister dome 12 typically cool to the extent that they do not impede the bending at the fold line 53. Should this not be adequate in certain cases, a cooled plate can be placed onto the sealed region in an interposed station in order to accelerate the cooling process.

Two pallet belts 9, 10 are provided in the illustrated example. It is also possible in principle to position all of the stations in a single pallet belt of an appropriate length.

Also shown is a single-row arrangement of blister domes 12 for each pallet 11. In other words, one row of blister domes 12 is shaped, severed and placed onto each pallet 11 per cycle. A double-row arrangement of blister domes 12 is conceivable when double-blisters are shaped, separated from the film sheet 48 and split in an interposed transverse-cutting device, spaced from one another in the transport direction and then inserted into the pallet belt 9 in double rows.

Two stations, the folding station 33. and a subsequent sealing station 59, are provided for folding the carrier part 14 and sealing it with the blister edges 50. It is possible in principle to provide a combination folding/sealing station by arranging the bending strip 43 to execute a correspondingly large horizontal displacement movement and a small vertical movement, and disposing the sealing electrode 46 above the bending device 42 (shown in a dot-dash line in FIG. 4). After the carrier part 14 has been bent by the horizontal displacement of the bending strip 43, the sealing electrode 46 travels downward, thereby completing the folding process and, immediately thereafter, effecting the sealing process.

The invention now being fully described, it will be apparent to one of ordinary skill in the art that many changes and modifications can be made thereto without departing from the spirit or scope of the invention as set forth herein.

What is claimed is:

1. A method for producing stand-up blister packages, in which blister domes with blister edges are shaped from a film sheet of thermoplastic plastic, separated from the film sheet, transferred into circulating, cyclically-moved sealing pallets, filled with an item, and sealed with a carrier part through large-surface heating of the blister edges, said method including the following method steps:

sealing one of the blister edges with the carrier part in a transverse-sealing station;

cooling the one blister edge and the carrier part to form a stand-up blister package preform;

linearly heating a transition region of the blister edge between the blister dome and the carrier part in a heating station to form a narrow, heated fold line;

folding the carrier part, and the blister edge connected thereto, by 180° along this heated fold line; and sealing remaining blister edges with the carrier part to form a sealed stand-up blister package.

2. The method according to claim 1, further comprising forming a groove in the blister edge during the heating of the fold line.

3. The method according to claim 1 wherein the cooling step includes cooling the sealed blister edge and the adjoining region of the blister dome inactively during transport over a corresponding distance between the transverse-sealing station and the heating station.

4. The method according to claim 1 wherein the cooling step includes accelerating the cooling of the blister edge and the adjoining region of the blister dome by placing a cooling plate onto the sealing surface formed by the blister edge and the carrier part.

5. The method according to claim 1 wherein the carrier part is folded and sealed with the remaining blister edges in two separate stations.

6. The method according to claim 1, wherein the carrier part is folded and sealed with the three blister edges in a single combination folding/sealing station.

7. The method according to claim 1 further including filling the blister domes after the sealing of the one blister edge with the carrier part.

8. The method according to claim 1 further including initially inserting the blister domes into openings in the pallets; raising the blister domes from a surface of the pallets in a downstream positioning station and, in this raised position, placing the carrier parts onto the surface of the pallets such that a blister edge rests on the carrier part when the blister domes are re-lowered; and then lowering the blister domes.

9. An apparatus for producing stand-up blister packages including a blister dome sealed to a carrier part comprising: a shaping section for providing shaped blister domes having blister edges; and a sealing section including at least one circulating pallet belt having pallets with openings for receiving the blister domes and carrier parts on a surface of the pallets such that one blister edge overlaps a portion of the respective carrier, a filling station, a transverse-sealing station for sealing the one blister edge with the carrier part, a folding station for folding the carrier part by 180° relative to the one blister edge, a sealing station for sealing the other blister edges with the carrier part, and a heating station that is disposed between the transverse-sealing station and the folding station, with the heating station having a heated heating strip for warming a linear region of the blister dome edge in order to create a heated fold line.

10. The apparatus according to claim 9, wherein the heating strip tapers to a slightly-rounded point.

11. The apparatus according to claim 9, wherein a counter-strip is provided opposite the heating strip.

12. The apparatus according to claim 9, further comprising a drive for vertically moving the heating strip and exerting an adjustable pressing force.

13. The apparatus according to claim 9, wherein the sealing station is disposed downstream of the folding station.

14. The apparatus according to claim 9, wherein the sealing station is combined with the folding station and has a vertically-moving sealing electrode.

15. The apparatus according to claim 9, wherein the sealing section has two circulating pallet belts with a transfer device there between.

16. The apparatus according to claim 9, further comprising a lifting device, which is disposed in a positioning station for the carrier parts, for temporarily lifting the blister domes out of the pallets to allow placement of a carrier part on the surface of a pallet such that the one blister edge overlaps the carrier part when the lifted blister dome is lowered.

17. The apparatus according to claim 9 further comprising a station disposed between the transverse-sealing station and the heating station, and having a cooling plate for temporary placement onto the seal region.

18. The apparatus according to claim 9, wherein the filling station is disposed between the transverse-sealing station and the folding station.

* * * * *